US012773591B2

(12) United States Patent
Wang

(10) Patent No.: US 12,773,591 B2
(45) Date of Patent: Oct. 27, 2026

(54) DUMBBELL

(71) Applicant: YONGKANG YASHI INDUSTRY & TRADE CO., LTD., Jinhua (CN)

(72) Inventor: Chaohui Wang, Jinhua (CN)

(73) Assignee: YONGKANG YASHI INDUSTRY & TRADE CO., LTD., Jinhua (CN)

( * ) Notice: Subject to any disclaimer, the term of this patent is extended or adjusted under 35 U.S.C. 154(b) by 0 days.

(21) Appl. No.: 19/287,843

(22) Filed: Aug. 1, 2025

(65) Prior Publication Data

US 2026/0192146 A1 Jul. 9, 2026

(30) Foreign Application Priority Data

Jan. 7, 2025 (WO) ..... PCT/CN2025/070900

(51) Int. Cl.
*A63B 21/072* (2006.01)
*A63B 21/075* (2006.01)

(52) U.S. Cl.
CPC ..... *A63B 21/0726* (2013.01); *A63B 21/0728* (2013.01); *A63B 21/075* (2013.01)

(58) Field of Classification Search
CPC ..... A63B 21/072; A63B 21/0722; A63B 21/0724; A63B 21/0726; A63B 21/0728; A63B 21/075
See application file for complete search history.

(56) References Cited

U.S. PATENT DOCUMENTS

| | | | | |
|---|---|---|---|---|
| 11,771,941 | B2 * | 10/2023 | Luo | A63B 21/075 482/108 |
| 12,357,866 | B1 * | 7/2025 | Wu | A63B 21/0728 |
| 2022/0152443 | A1 | 5/2022 | Casagrande | |
| 2025/0242191 | A1 * | 7/2025 | Collner | A63B 21/0724 |

FOREIGN PATENT DOCUMENTS

| | | | |
|---|---|---|---|
| CN | 215136446 | U | * 12/2021 |
| CN | 216169660 | U | 4/2022 |
| CN | 219646634 | U | 9/2023 |
| JP | 2021526953 | A | 10/2021 |
| JP | 3240627 | U | 1/2023 |

OTHER PUBLICATIONS

Notice of Allowance of counterpart Japanese Patent Application No. 2025-086611 issued on Jul. 9, 2025.

* cited by examiner

*Primary Examiner* — Zachary T Moore

(57) ABSTRACT

The present patent provides a dumbbell. It is composed of a handle, a weight adjustment mechanism, and multiple sets of weight plates respectively set at both axial ends of the handle. The handle consists of a rotary drum and a retractable rod passing through the rotary drum. The weight adjustment mechanism contains a turnplate and a toothed disc coaxially arranged with the rotary drum. The turnplate is fixedly connected to the rotary drum. The dumbbell provided by the present patent, composed of a handle, a weight plate, and a weight adjustment mechanism, depends on the linkage of the retractable handle and the driving wheel of the weight adjustment mechanism to enable users to mount different numbers of weight plates by directly rotating the handle, with no need of installing them one by one, which greatly simplifies the user's operation before use and at the time of replacement during use.

10 Claims, 16 Drawing Sheets

DUMBBELL

CROSS REFERENCE TO RELATED APPLICATIONS

The present application claims the benefit of PCT Application No. PCT/CN2025/070900 filed on Jan. 7, 2025, the contents of which are incorporated herein by reference in their entirety.

TECHNICAL FIELD

The present utility model patent relates to the field of fitness equipment technology, especially providing a dumbbell.

BACKGROUND ART

Dumbbells are auxiliary equipment used for fitness exercises, mainly divided into commercial and household types. Commercial dumbbells have site advantages, so they can be directly set up in multiple specifications for use. However, for household dumbbell products generated by the use demands for small family spaces, most of existing products that are commercially available are in a detachable form. Before use, the users need to manually install several independent dumbbell plates on the holding rod in sequence, they are fastened by bolts and other connectors, and there are more operation steps. This causes that, the installation preparation work before use, and the weight replacement operation during use, are extremely tedious, which easily affects the users'enthusiasm for exercises, and brings poor use experience. The detachable dumbbell needs to reserve a larger length of the holding rod to adapt to different weights, and the overlong holding rod further brings inconvenience to users.

SUMMARY OF THE INVENTION

The present patent provides a dumbbell to overcome the shortcomings of existing technologies.

In order to achieve the above purpose, the present patent provides the following technical proposal.

A dumbbell is composed of a handle, a weight adjustment mechanism, and multiple sets of weight plates respectively set at both axial ends of the handle, the handle consists of a rotary drum and a retractable rod passing through the rotary drum, the weight adjustment mechanism contains a turnplate and a toothed disc coaxially arranged with the rotary drum, the turnplate is fixedly connected to the rotary drum, a driving wheel is arranged in the circumferential direction of the turnplate, multiple grooves are set up at the end of the toothed disc in the form of spiral distribution, the groove is divided into first and second directional sub-tracks sequentially spaced and connected along the circumferential direction, the first directional sub-track is set up along the circumferential direction of the toothed disc, the second directional sub-track is inclined at a set angle along the radial direction of the toothed disc relative to the first directional sub-track, the retractable rod is provided with multiple toothed slots arranged along an axial array, and the driving wheel engages with the groove and the toothed slot.

Further, a limit bead is fixedly set up on the turnplate, the limit bead is composed of a sleeve and a ball head, the sleeve is provided with a spring for the ball head to press against the opening of the sleeve, and multiple gear slots are arranged along the circumferential ring array at the end of the toothed disc; during the rotation of the turnplate, the ball head tends to cooperate with the gear slot.

Further, several driving wheels are set up in the ring array centered on the axis of the rotary drum.

Further, there is also a counting module, the counting module is composed of a counting ring, a planetary gearset, an annular gear, and a counting gear, the counting gear is coaxially arranged on the turnplate, the counting ring is coaxially placed on the outer circumference of the turnplate, the planetary gearset is set up along the circumferential direction of the counting ring, the annular gear is fixedly placed, the inner and outer sides of the planetary gearset respectively engage with the counting gear and the annular gear, and a weight mark is set up on the outer circumference of the counting ring.

Further, a half weight plate is included, the middle part of the half weight plate is provided with a lifting hook, and multiple flanges are set up in the outer circumferential ring array of the turnplate; under the set rotation position of the turnplate, the flange is located directly below the lifting hook.

Further, a locking plate is placed on the outer circumference of the turnplate, a ring gear is arranged on the outer circumference of the turnplate, and a stop gear is set up on the inner circumference of the locking plate which is provided with a top spring that is used to drive the engagement between the stop gear and the ring gear.

Further, a base is used to place the dumbbell, and it is provided with the top block to press against the locking plate in the vertical direction.

Further, there is also a locking piece, the weight plate adopts the disc-shaped structure with a set thickness, the middle part of the weight plate is provided with the hole available for the retractable rod, a notch for the insertion of the locking piece is set up on the outer circumference of the weight plate, and the locking block is connected to two weight plates close to it.

Further, the top and bottom of the weight plate are provided with the notches, the inner wall of the notch has the slot available for the locking piece, a pin passes through the slot, the outer circumference of the locking piece has the semicircle matched with the outer circumference of the pin, the locking piece is provided with card slots and cardboards, and the card slots and cardboards are respectively connected to the adjacent cardboards and card slots.

Further, the weight adjustment mechanism is composed of the end plate and the housing; the end plate is fixedly connected to the housing, a chamber is formed inside to accommodate the turnplate, the outer end of the end plate is connected to the weight plate, the toothed disc is fixedly connected at the inner end of the end plate, and the rotary drum passes through the housing and the end plate; the spherical gear is set up on the outer circumference of the driving wheel, the rotation direction plane of the driving wheel is coincident with the axis of the rotary drum, and the outer wall of the rotary drum is provided with the slot available for the driving wheel; there is also a counting module, the counting module is composed of a counting ring, a planetary gearset, an annular gear, and a counting gear, the counting gear is coaxially arranged on the turnplate, the counting ring is coaxially placed on the outer circumference of the turnplate, the planetary gearset is set up along the circumferential direction of the counting ring, the annular gear is placed on the inner circumference of the housing, the inner and outer sides of the planetary gearset respectively engage with the counting gear and the annular gear, a weight mark is set up on the outer circumference of the counting ring, and the outer wall of the housing is provided with the window used to observe the outer circumference of the counting ring; there is also a half weight plate, the half weight plate is located below the housing, the middle part of the half weight plate is provided with the lifting hook, and the bottom of the housing has an opening for the lifting hook to pass upwards; the locking plate is included, and is placed on the outer circumference of the turnplate, with a top spring, and both ends of the top spring are respectively connected to the locking plate and the end plate.

In conclusion, the present patent has the following advantages:

The dumbbell provided by the present patent, composed of a handle, a weight plate, and a weight adjustment mechanism, depends on the linkage of the retractable handle and the driving wheel of the weight adjustment mechanism to enable users to mount different numbers of weight plates by directly rotating the handle, with no need of installing them one by one, which greatly simplifies the user's operation before use and at the time of replacement during use. Through the combination of the driving wheel and the grooved track in two directions, during the continuous rotation of the handle, the retractable rod is extended by the set length segment by segment, and adapts to the thickness of the weight plate, to enable users to accurately and quantitatively control the retractable length, which greatly improves the user experience.

Marks in figures: 11. Rotary Drum; 111. Slot; 12. Retractable Rod; 121. Toothed Slot; 21. Housing; 22. End Plate; 23. Turnplate; 231. Counting Gear; 232. Ring Gear; 233. Flange; 234. Limit Bead; 24. Driving Wheel; 25. Toothed Disc; 251. First Directional Sub-track; 252. Second Directional Sub-track; 253. Gear Slot; 26. Locking Plate; 261. Top Spring; 262. Stop Gear; 27. Counting Ring; 271. Planetary Gearset; 28. Half Weight Plate; 281. Lifting Hook; 3. Weight Plate; 31. Hole; 32. Notch; 331. First Locking Piece; 332. Second Locking Piece; 4. Base; 41. Groove; 42. Top Block

DETAILED DESCRIPTION

The implementation mode of the present patent is explained through specific embodiments. Technicians in this field can easily understand other advantages and effects of the present patent according to the content disclosed in the specifications. The present patent can be implemented or applied through different specific implementation modes. The details in the specifications can be modified or changed based on different perspectives and applications, without departing from the spirit of the present patent. It has to be noted that, in the absence of conflict, the following embodiments and their features can be combined with each other.

It is necessary to note that, the illustrations provided in the following embodiments only illustrate the basic concept of the present patent in a schematic manner. Therefore, the illustrations only show the components related to the present patent, and are not drawn according to the actual number, shape and size of the components during implementation. In practice, the shape, quantity and proportion of each component can be arbitrarily changed, and the layout of the components may be more complicated.

All directional indications in the embodiment of the present patent (such as up, down, left, right, front, back, horizontal, vertical, etc.) are only used to explain the relative position relationship and motion of each component in a specific posture. If the specific posture changes, the directional indication will be modified accordingly.

Due to installation errors and other reasons, the parallel relationship involved in the present patent may actually be the approximate parallel relationship, and the vertical relationship may actually be an approximate vertical relationship.

Figure 1:
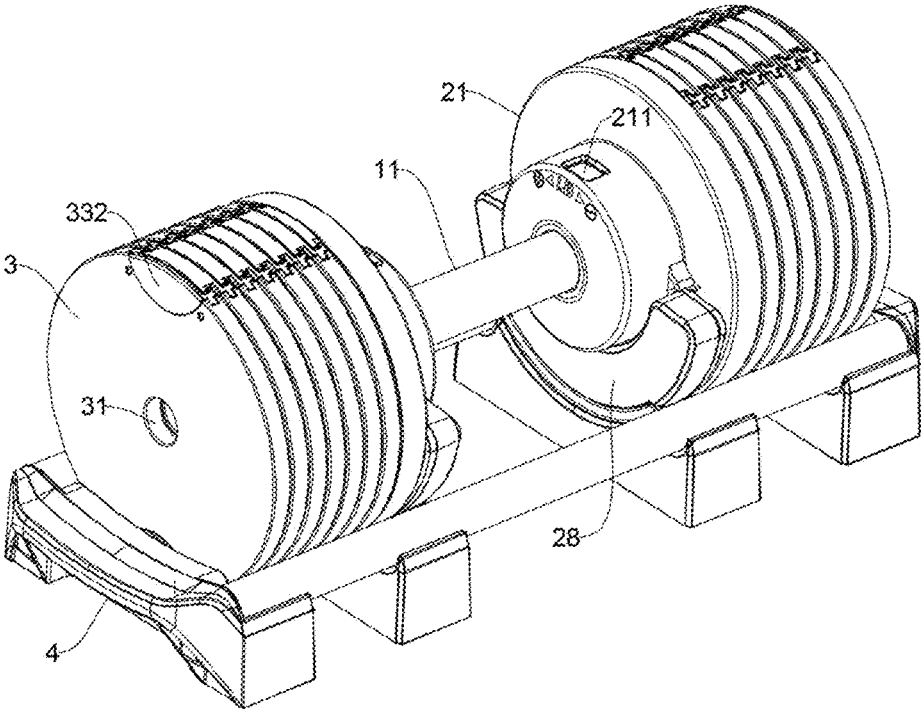
FIG. 1 is the schematic view of the dumbbell and base involved in the present patent.
Figure 2:
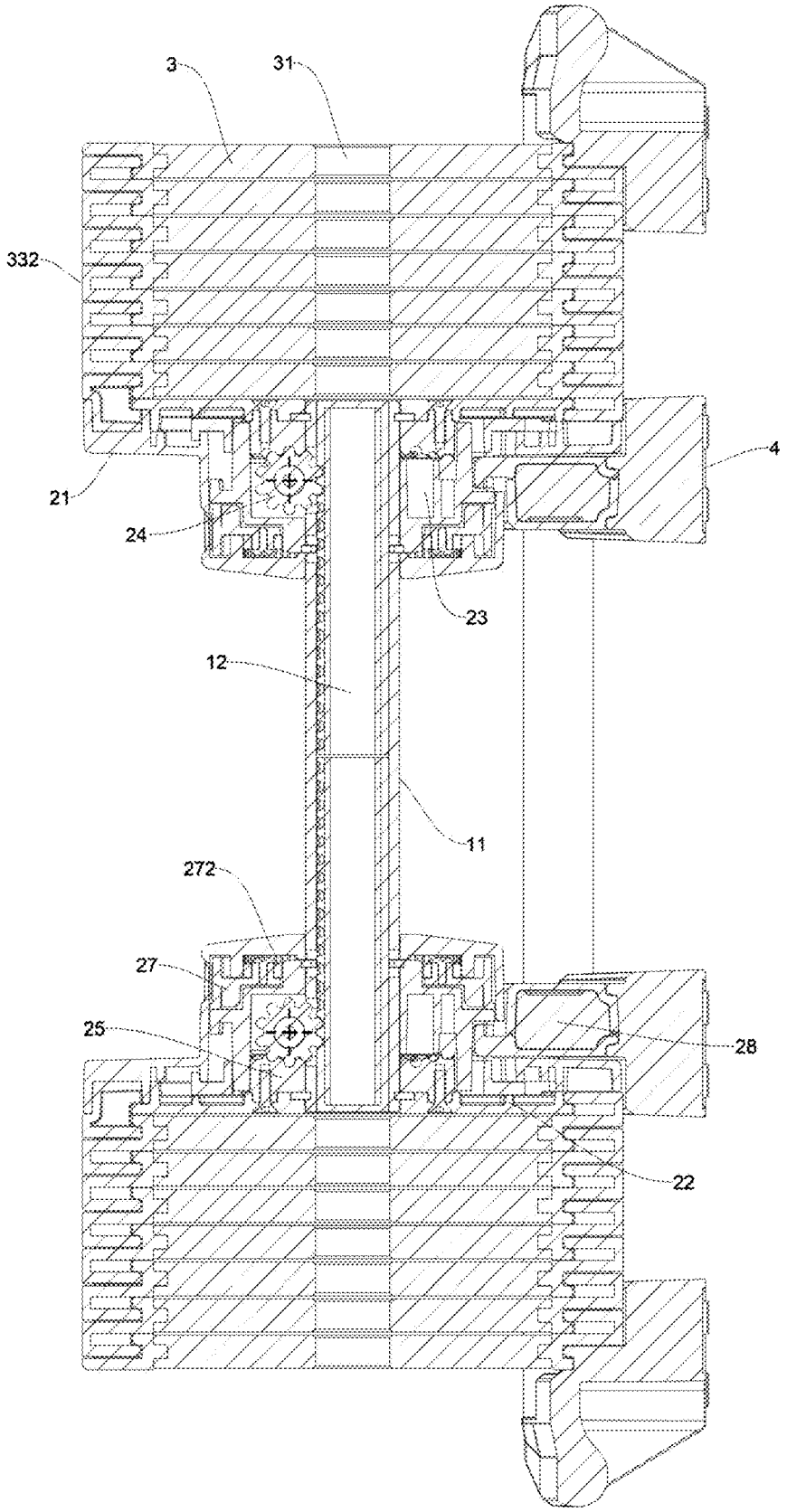
FIG. 2 is the section view of FIG. 1.
Figure 3:
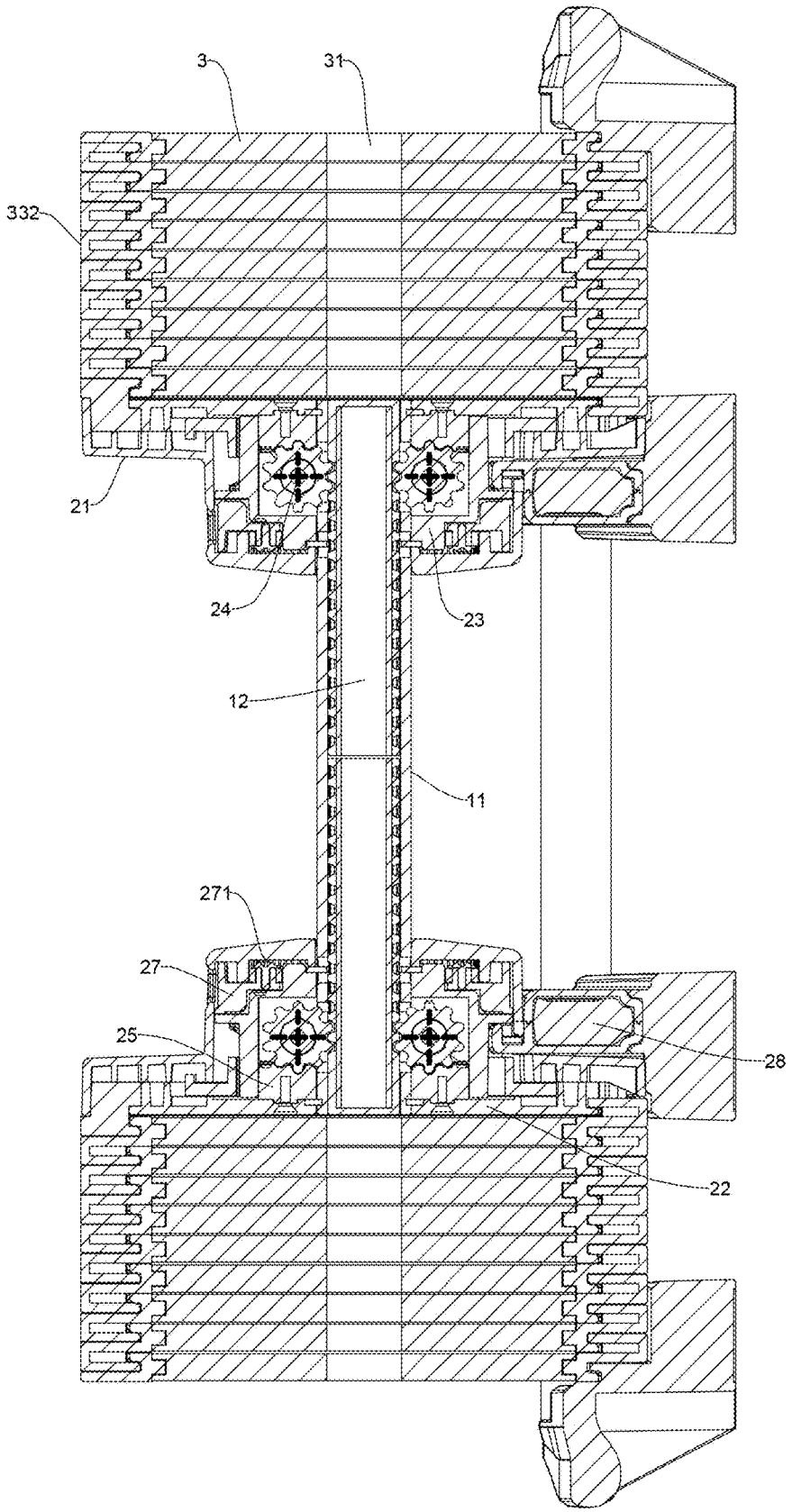
FIG. 3 is the section view in other embodiments of FIG. 2.

The present patent provides a dumbbell. As shown in FIG. 1, it is composed of a handle, weight plates 3 on both sides of the handle, and a weight adjustment mechanism for the fixed connection between the handle and the set quantity of weight plates 3.

Specifically, as shown in FIG. 2, FIG. 3, FIG. 4, FIG. 5 and FIG. 6, the handle is composed of a rotary drum 11 and a retractable rod 12, the rotary drum 11 adopts the hollow linear tubular structure, the outer circumference of the rotary drum 11 is processed with knurling patterns for anti-slip purpose, the retractable rod 12 is inserted into the rotary drum 11 along the axial direction of the rotary drum 11, the retractable rod 12 and the rotary drum 11 are assembled together by clearance fit, the retractable rod 12 can rotate and axially move relative to the rotary drum 11, and two retractable rods are symmetrically placed on both axial sides inside the rotary drum 11.

The weight plate 3 adopts the disc-shaped structure with a set thickness. Its peripheral shape includes but not limited to circle, square, polygon, etc. Multiple sets of weight plates 3 are arranged and distributed along the axis of the rotary drum 11 in a stacked manner, and there are multiple sets of weight plates 3 at both axial ends of the rotary drum 11. A hole 31 is set up in the middle of the weight plate 3. When the weight plate 3 is set, the hole 31 is located on the axis of the rotary drum 11, so that the retractable rod 12 can pass through the hole 31 when it moves axially.

Two sets of weight adjustment mechanisms are respectively located at both axial ends of the rotary drum 11, to respectively connect two sets of weight plates 3 on both sides of the rotary drum 11 to both ends of the rotary drum 11. The weight adjustment mechanism is composed of the end plate 22 and the housing 21. The end plate 22 is fixedly connected to the housing 21. A chamber is formed inside. The rotary drum 11 passes through the housing 21 and the end plate 22 along the axial direction, so that the rotary 11 passes through the chamber and it can rotate relative to the housing 21. In addition, the rotary drum 11 can rotate relative to the end plate 22. The outer end of the end plate 22 is connected to the closest weight plate 3 on the corresponding side.

As shown in FIG. 7, FIG. 8, FIG. 10, FIG. 11, FIG. 14, and FIG. 15, the weight adjustment mechanism is composed of a turnplate 23, a driving wheel 24, and a toothed disc 25. The toothed disc 25 is fixedly set up on the inner end of the end plate 22, and is coaxial with the inner end, and the rotary drum 11 or the retractable rod 12 can pass through the middle; the coaxial sleeve of the turnplate 23 is installed on the outer circumference of the rotary drum 11; the turnplate 23 is fixed connected to the rotary drum 11 through splines and other forms to prevent rotation, so that the rotation of the rotary drum 11 synchronously drives the rotation of the turnplate 23; multiple driving wheels 24 are set up radially on the outer circumference of the rotary drum 11 in a radial direction, and the axis of the driving wheel 24 is perpendicular to that of the rotary drum 11. Specifically, the rotation direction plane of the driving wheel 24 is coincident with the axis of the rotary drum 11, and the turnplate 23 is provided with the slot, so that the axle of the driving wheel 24 is clamped in the slot. When the turnplate 23 rotates, it synchronously drives the rotation of the driving wheel 24 centered on the axis of the rotary drum 11.

In some preferred embodiments, the number of the driving wheels 24 is set to be two or three, and the driving wheels 24 are arranged in the ring array centered on the axis of the rotary drum 11, to improve the driving transfer stability of the driving wheel 24.

As shown in FIG. 10, FIG. 11, FIG. 12 and FIG. 13, the outer circumference of the driving wheel 24 is designed with the spherical gear structure, multiple grooves are arranged in a shape of swirling along the circumferential direction at the end of the toothed disc 25. One or more spherical gears on the driving wheel 24 can form the spherical fit with the multiple grooves. When the driving wheel 24 rotates, the groove becomes the track for the axial movement of the spherical gear along the toothed disc 25. Thereinto, there are first and second directions when the track is set up in the circumferential direction of the toothed disc 25. In the embodiment, the track is divided into multiple parts in the circumferential ring array of the toothed disc 25, including multiple first directional sub-tracks 251 and multiple second directional sub-tracks 252. The first directional sub-track 251 and the second directional sub-track 252 are connected at successive intervals. The first directional sub-track 251 is in the same circumferential direction as the toothed disc 25. The second directional sub-track 252 is inclined at a set angle along the radial direction of the toothed disc 25 relative to the first directional sub-track 251. It is preferred that there are three first directional sub-tracks 251 and three second directional sub-tracks 252.

The spherical gear forms the spherical fit with the track. When the driving wheel 24 rotates, the spherical gear moves along the circumferential direction of the track. When the driving wheel 24 moves completely along any first directional track, there is no rotation of the driving wheel 24. When the driving wheel 24 moves completely along any second directional track, the driving wheel 24 rotates at a set angle.

There is no specific correspondence between the number of driving wheels 24 and the number of grooves. Only at the same time, multiple driving wheels 24 respectively engage with the same position on multiple first directional sub-tracks 251, or the same position on multiple second directional sub-tracks 252.

The outer wall of the rotary drum 11 is provided with the slot 111 that passes through the inner side of the rotary drum 11. Several sets of gear rows are placed on the outer circumference of the retractable rod 12. The gear row includes the multiple toothed slots 121 arranged in the axial array along the retractable rod 12. Several sets of gear rows are arranged in the circumferential ring array along the retractable rod 12, which is respectively used to engage with multiple driving wheels 24. The part of the driving wheel 24 passes through the slot 111, so that the spherical gear forms the spherical fit with the toothed slot. When the driving wheel 24 rotates, the driving wheel 24 drives the axial movement of the retractable rod 12.

When the weight of the dumbbell is set up, multiple sets of weight plates 3 are respectively placed on both sides of the handle. The preferred number of weight plates 3 on both sides of the handle shall be consistent. The user can hold the rotary drum 11 and directly drive its rotation to promote the rotation of the turnplate 23 and the driving wheel 24. Further, the rotation of the driving wheel 24 driven by the toothed disc 25 makes the retractable rod 12 move and stretch out. Rotating the rotary drum 11 at a set angle causes the retractable rod 12 to extend by the set length. The retractable rod 12 passes through several sets of weight plates 3 along the axial direction, to form the vertical contact support for the weight plate 3, so that the dumbbell can be lifted and used at this time.

In order to intuitively reflect the weight to the user, the weight adjustment mechanism also includes a counting module. As shown in FIG. 1, FIG. 4, FIG. 7, and FIG. 8, the counting module is composed of the counting ring 27, the planetary gearset 271, and the counting gear 231. The counting gear 231 is coaxial to the turnplate 23, and is fixedly connected to the turnplate 23. The planetary gearset 271 is placed on the outer circumference of the rotary drum 11 along the radial direction. In the embodiment, it is preferred that the planetary gearset 271 has multiple planetary gears that are arranged in the ring array centered around the rotary drum 11. The annular gear is set up on the inner circumference of the housing 21. The outer side of the planetary gear engages with the annular gear that fits with the counting gear 231, so that the rotation of the planetary gear is driven when the rotation of the rotary drum 11 drives the rotation of the turnplate 23 and the counting gear 231.

The counting ring 27 is coaxially placed on the outer circumference of the rotary drum 11, and the relative rotation can be achieved. The axial end of the central axis of the planetary gear passes through the counting ring 27. Therefore, when the planetary gear rotates, it synchronously drives the rotation of the counting ring 27. The outer side of the counting ring 27 is provided with multiple weight marks along a circumferential direction. There are numerical symbols of kilograms. Each numerical symbol of kilograms is corresponding to different weight information. An observation window is set up on the top of the housing 21, so that the user can see the numerical symbols of kilograms at the current position through the observation window.

Further, multiple hemispherical gear slots are in the circumferential ring array at the end of the toothed disc 25. The turnplate 23 is provided with multiple limit beads 234 arranged in the circumferential ring array relative to the end of the toothed disc 25.

The limit bead 234 is composed of a sleeve and a ball end. One end of the sleeve is fixedly connected to the turnplate 23. The other end of the sleeve adopts the open structure. The ball head is clamped at the opening of the sleeve, and can move in the sleeve. A spring is installed inside the sleeve to maintain the ball head at the opening. The ball head of the limit bead 234 faces towards the toothed disc, and is pressed against the end of the toothed disc 25. The ball head is partially pressed into the sleeve. The inner diameter of the circumference formed by the distribution of multiple limit beads is the same as the inner diameter of the circumference formed by the distribution of multiple gear slots. Therefore, when the turnplate 23 rotates, the limit bead 234 rotates along the end of the toothed disc 25; during the rotation, any ball head is corresponding to any gear slot, so that the ball head can enter the gear slot. With the continuous rotation of the turnplate 23, the ball head is removed from the gear slot and is matched with the next gear slot in the direction of movement.

In the embodiment, it is preferred that the spacing between adjacent toothed slots 121 in the tooth row is equal to the thickness of the single weight plate 3. Therefore, when the retractable rod 12 moves axially through the spacing of a pair of toothed slots 121, the extended length of the retractable rod 12 can carry an additional weight plate 3. In addition, the driving wheel 24 can sequentially travel the distance of the first directional track 251 and the second directional track 252 along the toothed disc. The turnplate 23 can rotate relative to the toothed disc 25 by an angle between two adjacent gear slots, so that the limit bead 234 moves from one gear slot to the next gear slot.

When the user operates the handle to set the weight plate 3 through the setting of the counting module, during the rotation of the rotary drum 11, the linked counting ring 27 synchronously rotates by the corresponding angle to display the current numerical symbol of kilograms at the observation window in a real-time manner, so that the user can obtain the weight information of the weight plate 3 currently mounted on the handle through the observation window. In addition, during the operation, the coordinated action between the limit bead 234 and the gear slot can generate the corresponding tactile feedback on the handle, so that the user can perceive it.

Figure 5:
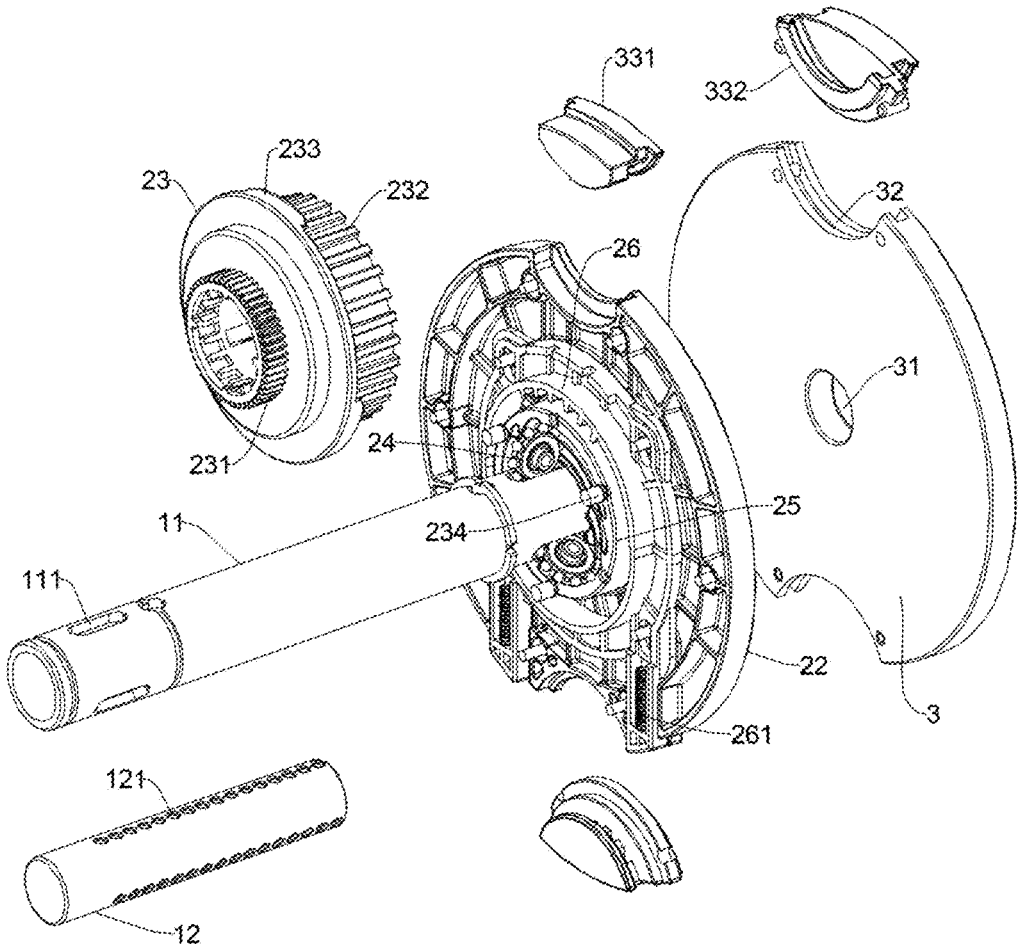
FIG. 5 is the exploded view of FIG. 4.
Figure 6:
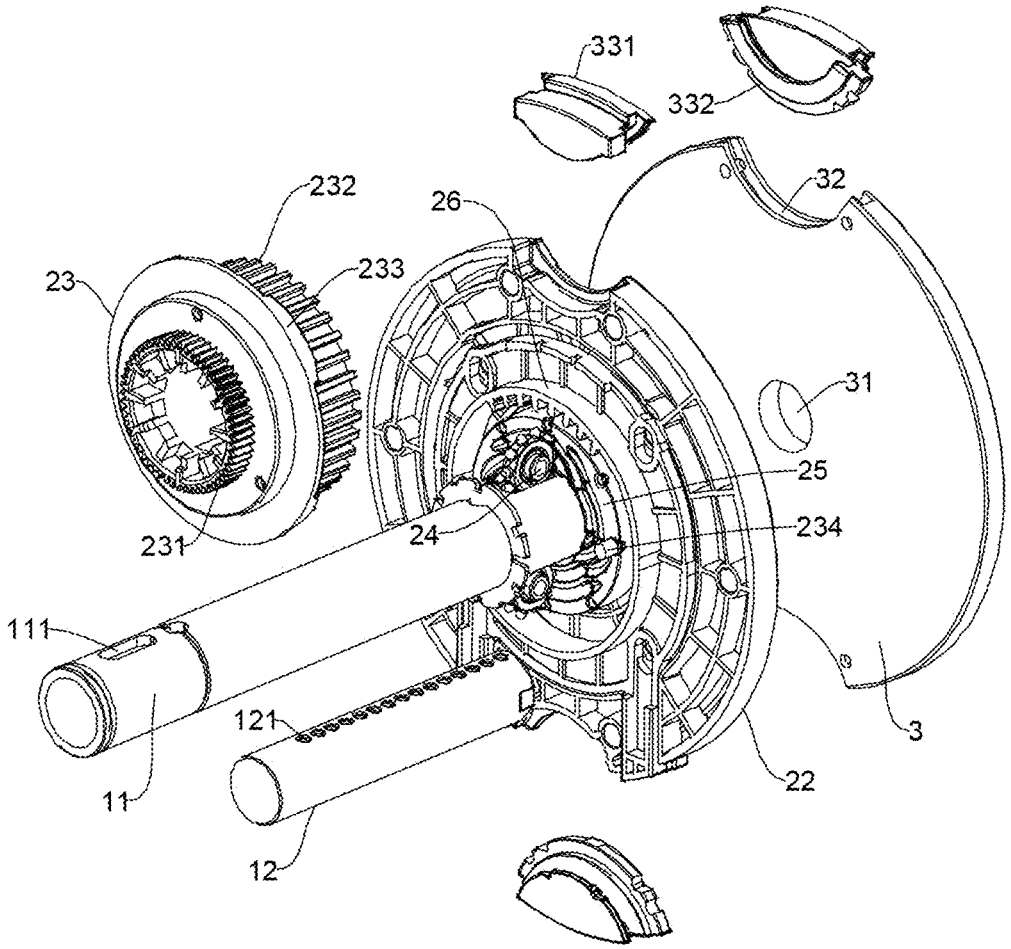
FIG. 6 is the exploded view in other embodiments of FIG. 5.

In order to ensure the tight stacking of multiple sets of weight plates 3 in the axial direction, and prevent the weight plate 3 from falling off during the use of the dumbbell, the locking piece is provided in the embodiment. As shown in FIG. 1, FIG. 5, and FIG. 6, the locking piece is composed of the first locking piece 331 and multiple second locking pieces 332. Thereinto, the first locking piece 331 is used for the connection between the end plate 22 and the weight plate 3; the second locking piece 332 is used for the connection between the adjacent weight plates 3.

Specifically, the crescent notch 32 is set up in the circumferential direction of the weight plate 3. In the embodiment, the top and bottom of the weight plate 3 are respectively provided with the notch 32. The inner wall of the notch 32 has the slot, and the weight plate 3 is provided with a pin that passes through the slot along the axial direction. The second locking piece 332 adopts the gibbous structure. The second locking piece 332 fits with the notch 32 of the weight plate 3 so that the weight plate 3 forms a complete circle. The outer wall of the second locking piece is provided with the insertion piece that has the semicircle matched with the outer circumference of the pin. The insertion piece is inserted into the slot to limit the pin to achieve the close fitting between the second locking piece 332 and the weight plate 3. The second locking piece 332 is sequentially provided with card slots and cardboards. When multiple sets of weight plates 3 are set, the current card slot of the second locking piece 332 is used to engage with the cardboard of the second locking piece 332 on the previous weight plate 3, and the current cardboard of the second locking piece 332 is used to engage with the card slot of the second locking piece 332 on the back weight plate 3, to achieve the close connection among multiple sets of weight plates 3.

The gibbous notch 32 is set up in the circumferential direction of the end plate 22; one side of the first locking piece 331 is inserted in the notch 32, and closely fits with the end plate 22; the other side is provided with the cardboard to insert into the card slot of the second locking piece 332 on the closest adjacent weight plate 3, to achieve the close connection between the weight plate 3 and the end plate 22.

Figure 16:
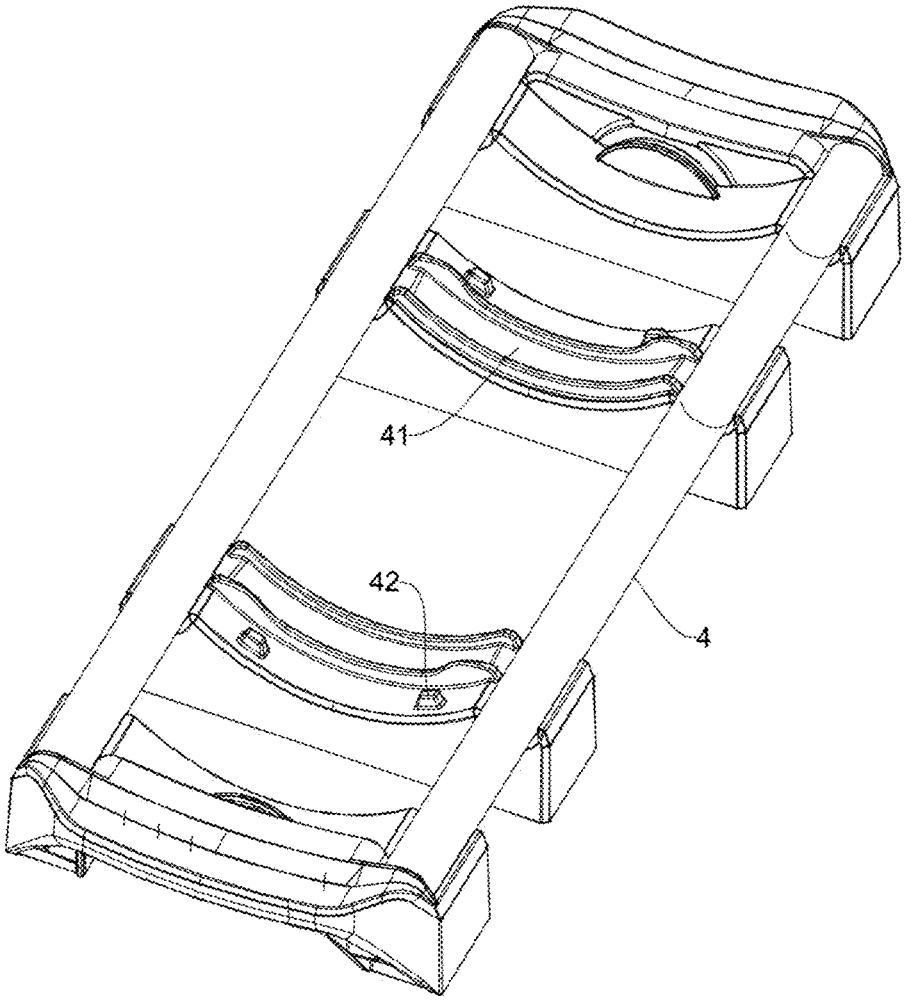
FIG. 16 is the schematic view of the base involved in the present patent.

In order to steadily place the dumbbell and facilitate the weight adjustment operation of the user, the base 4 is described in the embodiment. As shown in FIG. 1 and FIG. 16, the handle and the weight plate 3 are removable and placed on the base 4.

Figure 4:
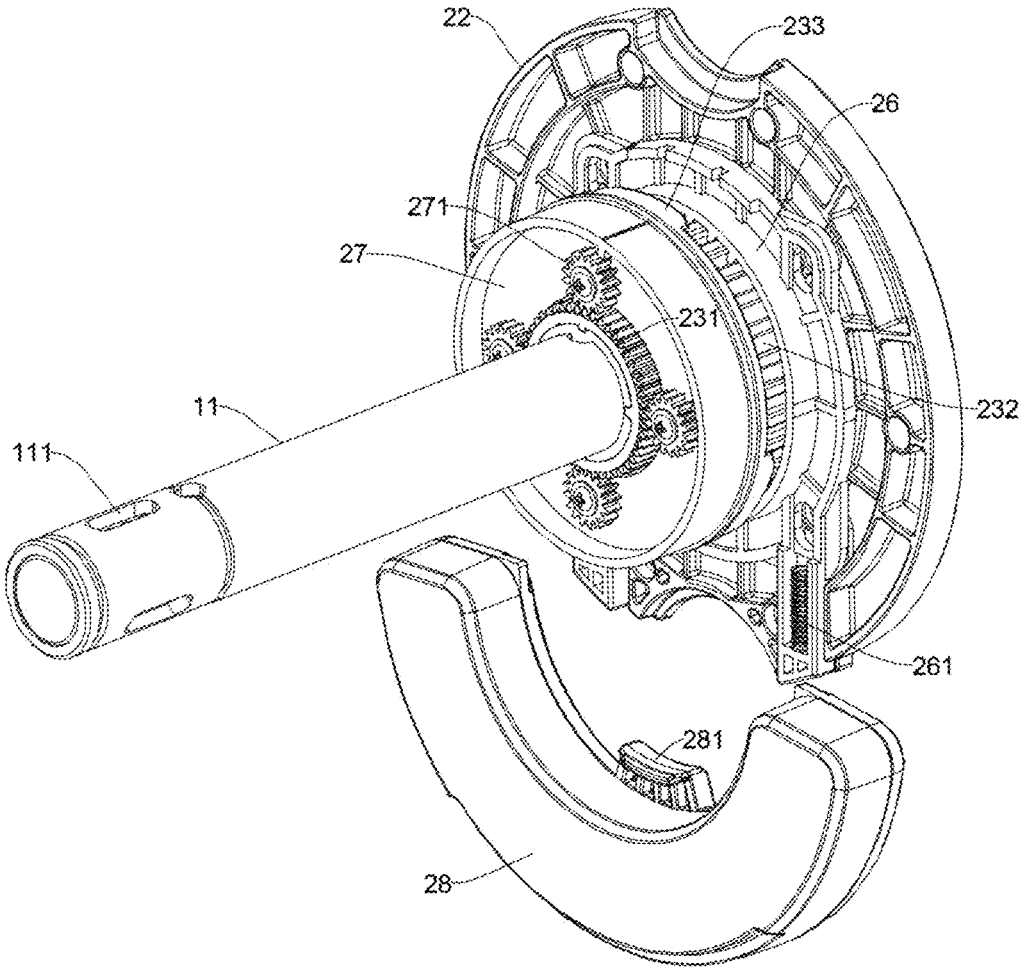
FIG. 4 is the partial schematic view of the weight adjustment mechanism involved in the present patent.
Figure 7:
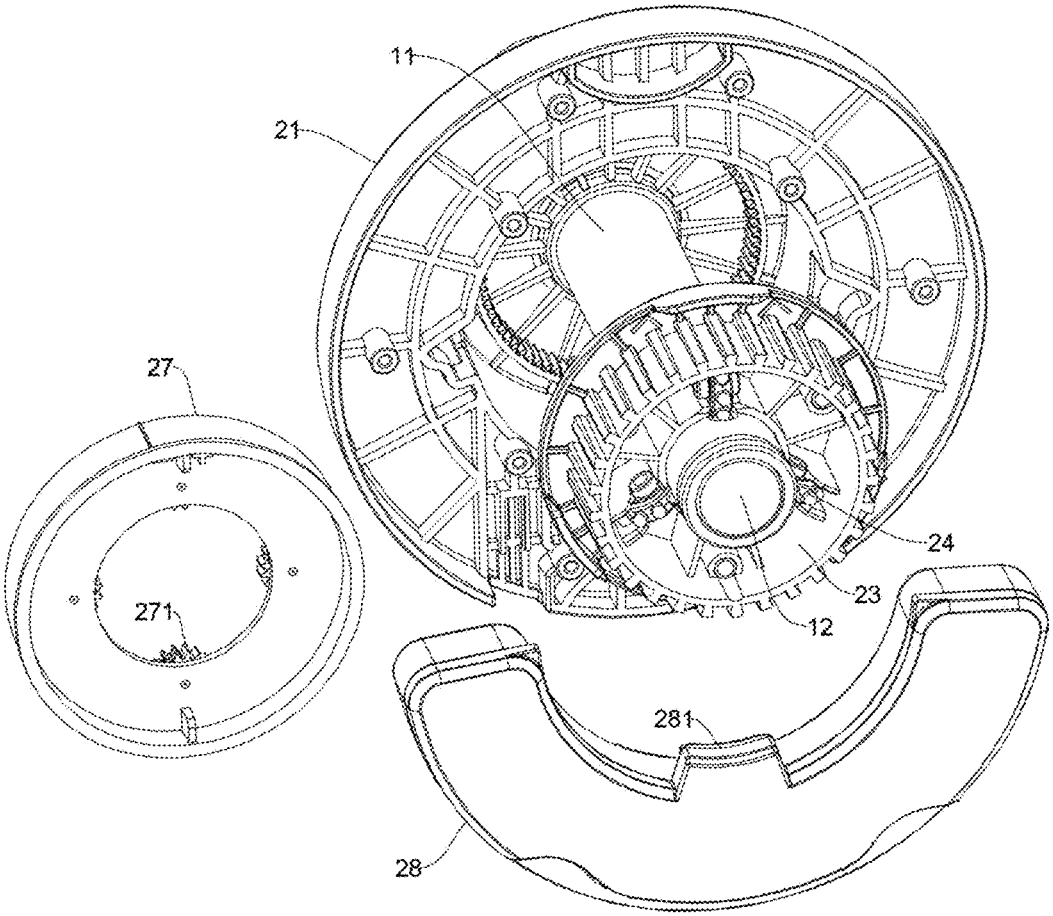
FIG. 7 is the exploded view of FIG. 4 from another perspective.
Figure 8:
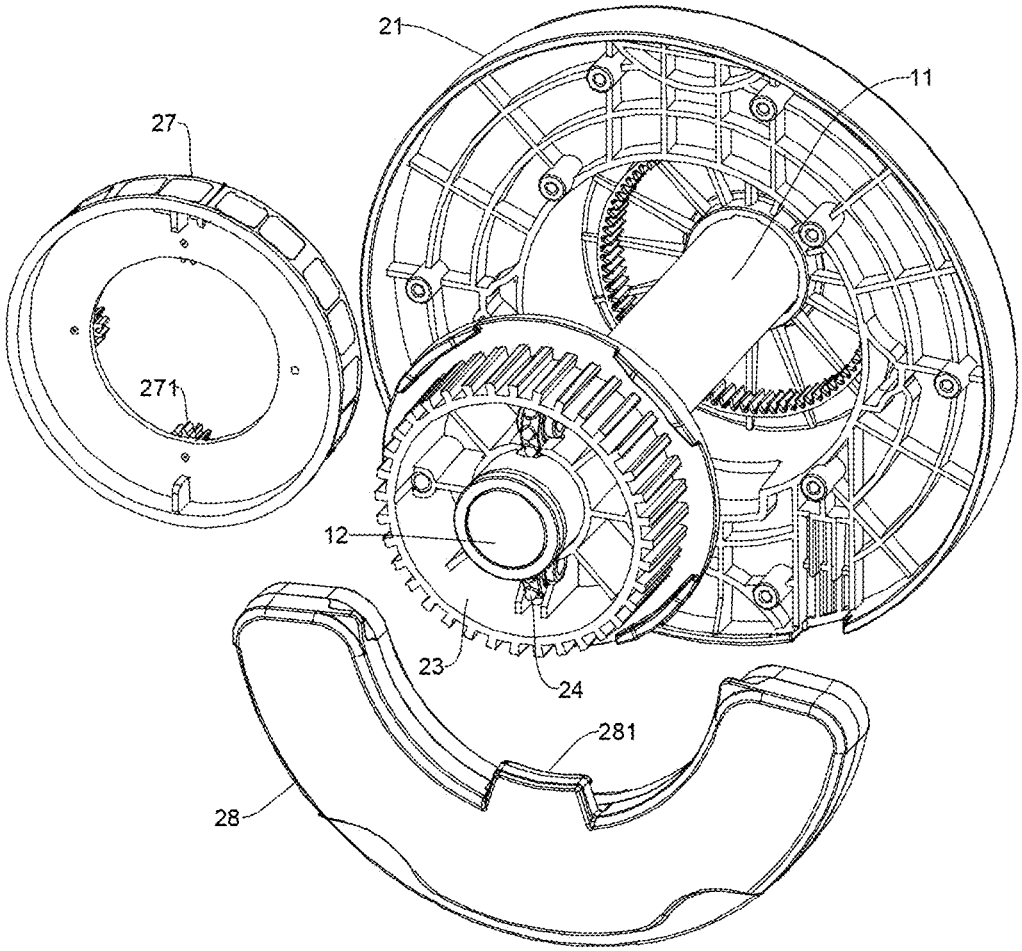
FIG. 8 is the exploded view in other embodiments of FIG. 7.

In some embodiments, the weight adjustment mechanism is provided with the half weight plate 28. As shown in FIG. 4, FIG. 7, and FIG. 8, the half weight plate 28 adopts the crescent structure, and is connected to the bottom of the housing 21 with the opening facing upwards; the base 4 is provided with the groove 41 that is matched with the half weight plate 28, and both ends of the half weight plate 28 are respectively pressed against the housing 21 to limit the rotation. The weight of the half weight plate 28 is a half of that of the weight plate 3.

The middle part of the half weight plate 28 is provided with the lifting hook 281, the bottom of the housing 21 has an opening to enable the lifting hook 281 to enter the chamber, multiple flanges 233 are set up in a circumferential array on the outer circumference of the turnplate 23, and the flange 233 can move directly below the lifting hook 281 during the rotation of the turnplate 23. When the dumbbell is lifted at this time, the half weight plate of the dumbbell can be lifted through the coordination of the flange 233 and the lifting hook 281.

Figure 14:
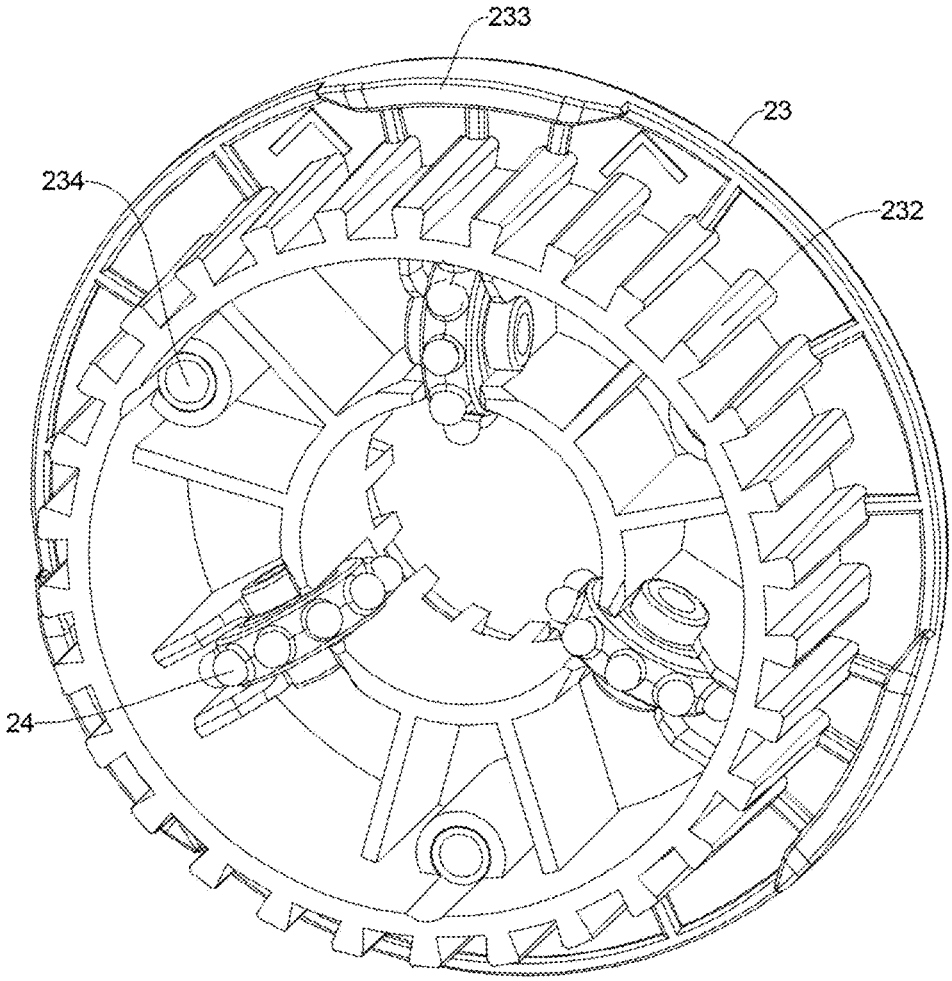
FIG. 14 is the schematic view of the turnplate and driving wheel involved in the present patent.

In some preferred embodiments, there are three flanges 233. As shown in FIG. 14, in case of weight adjustment, the single weight plate 3 is deemed as a unit, the weight on one side of the handle can be selected as 1 unit, 1.5 units and 2 units, and then the weight can be accumulated based on 0.5 units.

Figure 15:
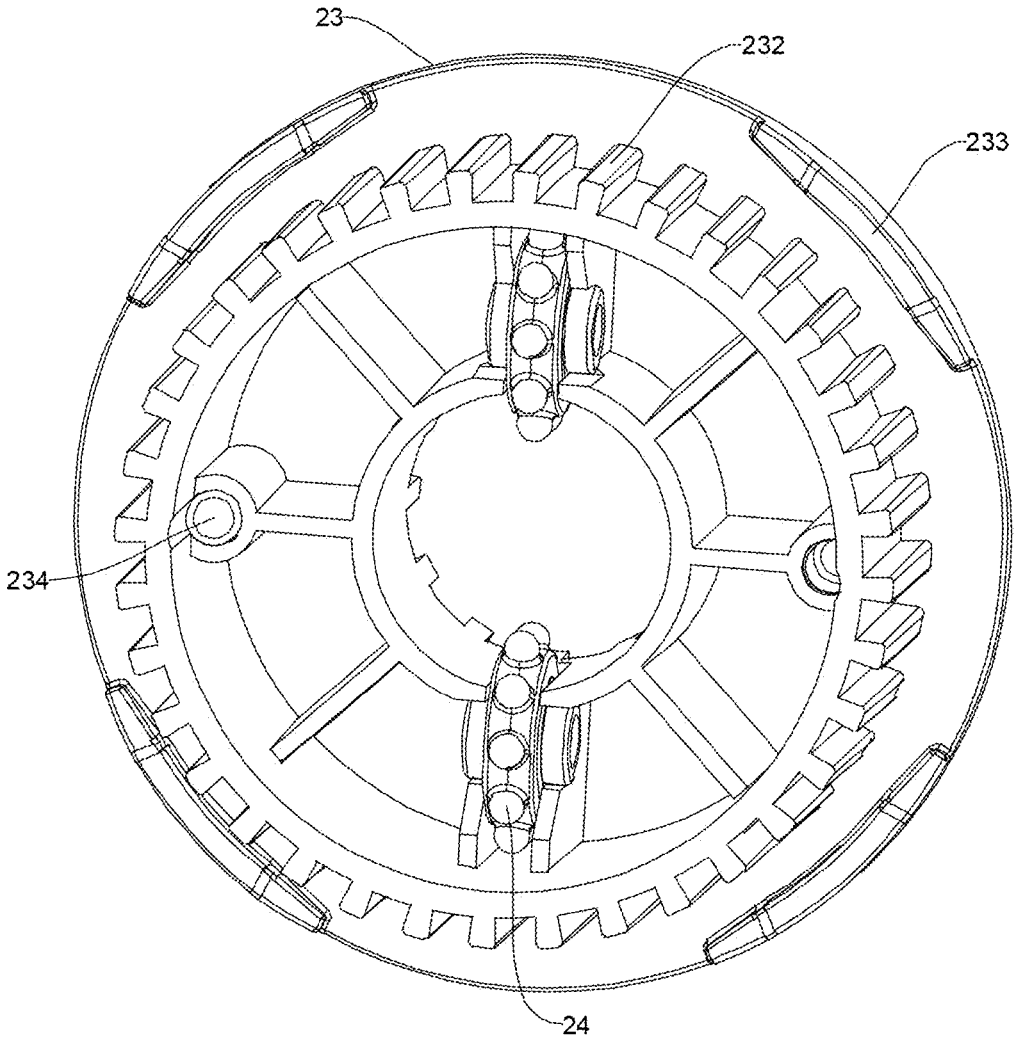
FIG. 15 is the schematic view in other embodiments of FIG. 14.

In other preferred embodiments, the number of flanges 233 may be four, as shown in FIG. 15.

Figure 9:
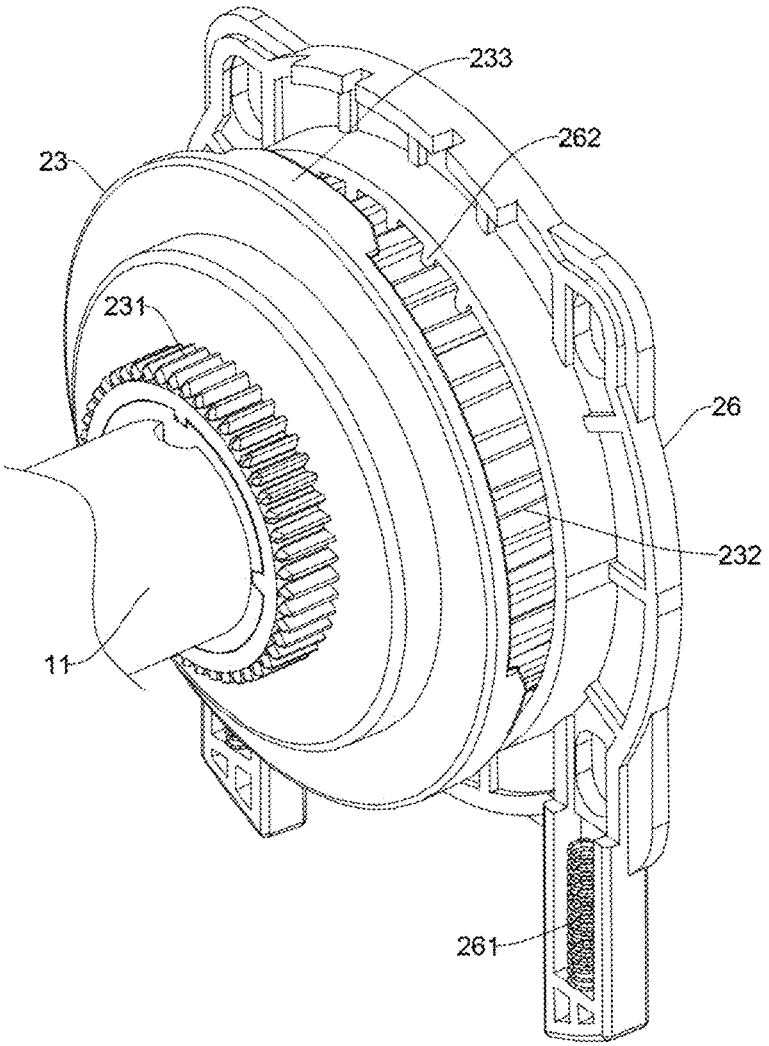
FIG. 9 is the schematic view of the turnplate and locking plate involved in the present patent.
Figure 10:
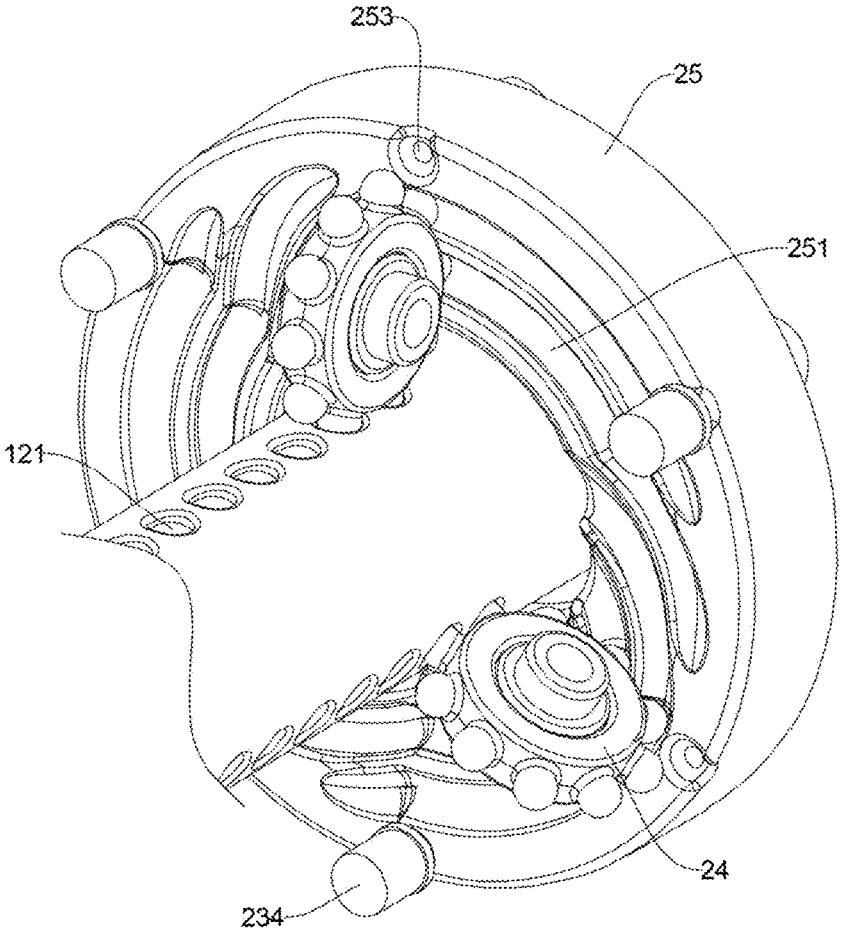
FIG. 10 is the schematic view of engagement between the driving wheel and the toothed disc/retractable rod involved in the present patent.
Figure 11:
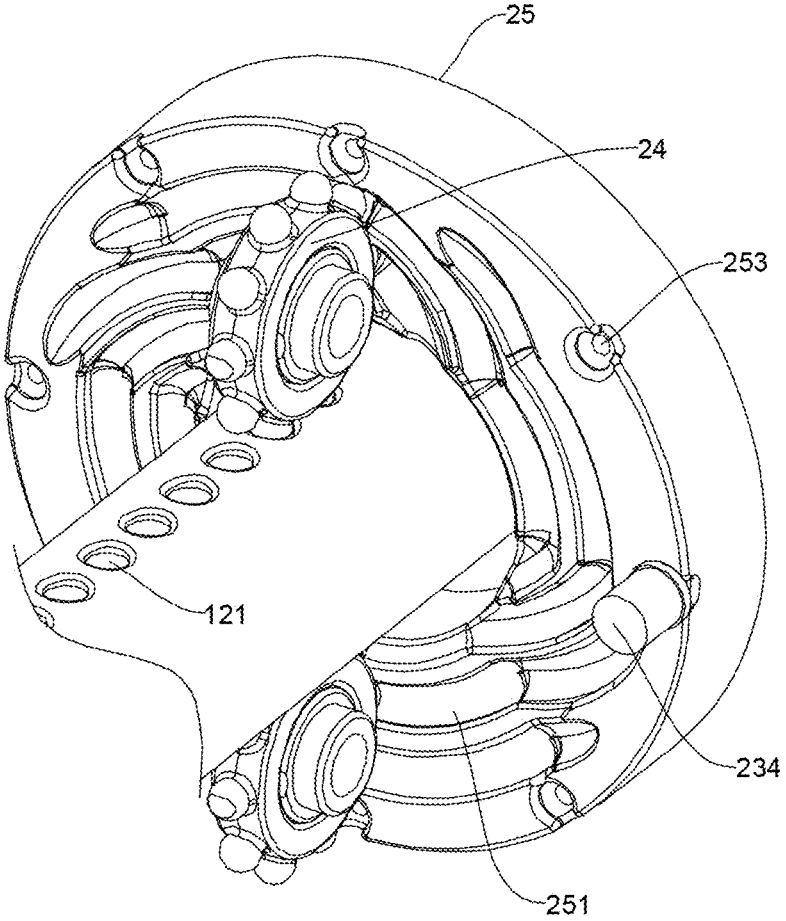
FIG. 11 is the schematic view in other embodiments of FIG. 10.
Figure 12:
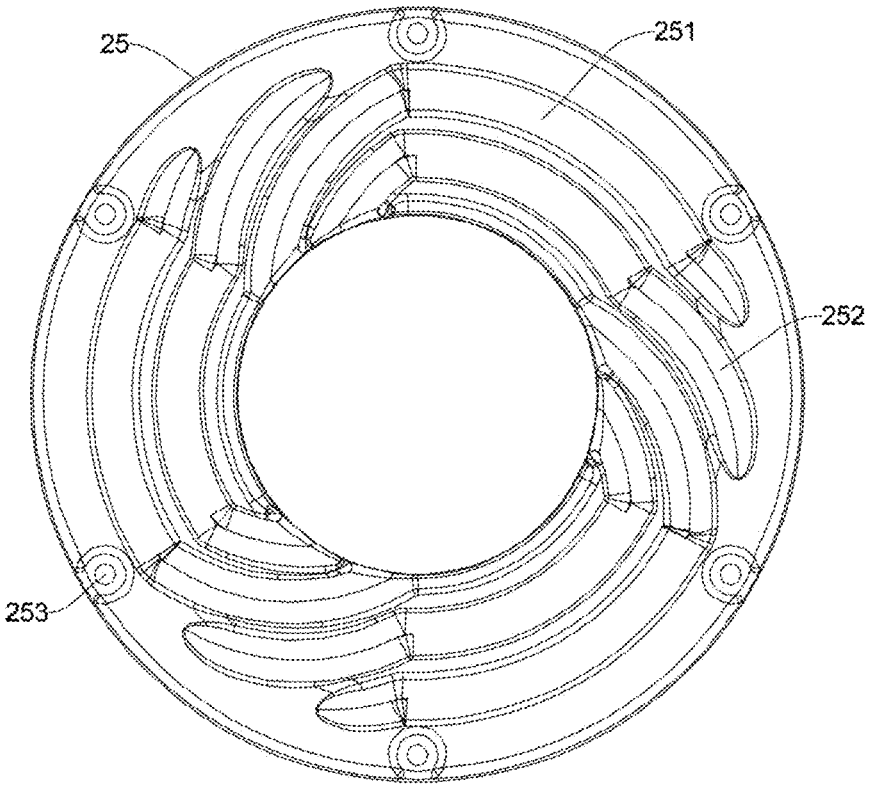
FIG. 12 is the schematic view of the toothed disc in FIG. 10.
Figure 13:
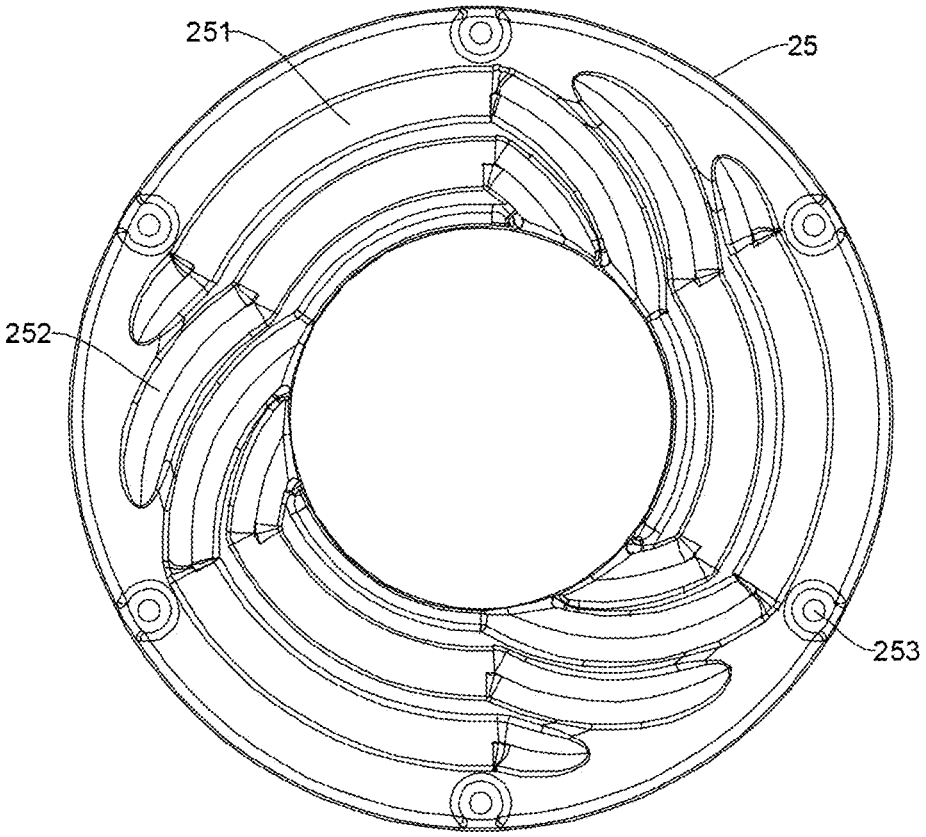
FIG. 13 is the schematic view of the toothed disc in FIG. 11.

The weight adjustment mechanism also contains the locking plate 26 that is used to lock the turnplate 23 at the time of lifting the dumbbell to prevent the rotation of the turnplate 23. Specifically, as shown in FIG. 9, the locking plate 26 is set up inside the chamber, the top spring 261 is installed between the locking plate 26 and the end plate 22, the both ends of the top spring 261 are respectively connected to the locking plate 26 and the end plate 22, and the top spring 261 is set up in a vertical direction, to provide the locking plate 26 with the elasticity in the vertical direction.

The locking plate 26 is placed on the outer circumference of the turnplate 23, and the ring gear 232 is set up on the outer circumference of the turnplate 23; the stop gear 262 is installed on the inner wall of the locking plate 26 facing the turnplate 23, and it is located above the turnplate 23; when the locking plate 26 is not subject to any other external force, it moves downwards under the action of elasticity of the top spring 261, so that the stop gear 262 engages with the ring gear 232, to stop the rotation of the locking plate 26 on the turnplate 24.

The lower end of the locking plate 26 extends downwards and is provided with a top rod, the bottom of the housing 21 has an opening for the top rod to extend downwards, and the top block 42 is set up on the corresponding position of the base 4 in the vertical direction. When the dumbbell is placed on the base 4, the top rod is in direct contact with the top block 42. The top block 42 pushes the top rod upwards, so that the locking plate moves upwards. At this time, the stop gear 262 is separated from the ring gear 232, so that the weight can be arbitrarily adjusted when the dumbbell is placed on the base 4.

Obviously, the described embodiments are only a part of the embodiments of the present patent, not all of them. Based on the embodiments of the present patent, other embodiments obtained by the general technicians in the field without creative design fall within the protection scope of the present patent.

What is claimed is:

1. A dumbbell, comprising:

a handle, a weight adjustment mechanism, and multiple sets of weight plates respectively set at both axial ends of the handle,;

wherein the handle consists of:

a rotary drum and a retractable rod (12) passing through the rotary drum;

wherein the weight adjustment mechanism contains a turnplate and a toothed disc coaxially arranged with the rotary drum, the turnplate (23) is fixedly connected to the rotary drum, a driving wheel (24) is arranged in a circumferential direction of the turnplate, wherein multiple grooves are set up at an end of the toothed disc in the form of spiral distribution, the groove being divided into first and second directional sub-tracks sequentially spaced and connected along a circumferential direction, wherein the first directional sub-track is along a circumferential direction of the toothed disc, wherein the second directional sub-track is inclined at a set angle along a radial direction of the toothed disc relative to the first directional sub-track;

the retractable rod is provided with multiple toothed slots arranged along an axial array,; and the driving wheel engages with the groove and the toothed slot.

2. The dumbbell of claim 1, wherein a limit bead is fixedly set up on the turnplate, the limit bead is composed of a sleeve and a ball head, the sleeve is provided with a spring for the ball head to press against an opening of the sleeve, wherein multiple gear slots are arranged along a circumferential ring array at the end of the toothed disc, and the ball head cooperates with the gear slot during the rotation of the turnplate.

3. The dumbbell of claim 1, wherein a plurality of driving wheels are set up in a ring array centered on an axis of the rotary drum.

4. The dumbbell of claim 1, wherein the dumbbell further comprises a counting module, the counting module is composed of a counting ring, a planetary gearset, an annular gear, and a counting gear, the counting gear is coaxially arranged on the turnplate, the counting ring is coaxially placed on an outer circumference of the turnplate, the planetary gearset is set up along a circumferential direction of the counting ring, the annular gear is fixedly placed, inner and outer sides of the planetary gearset respectively engage with the counting gear and the annular gear, and a weight mark is set up on an outer circumference of the counting ring.

5. The dumbbell of claim 1, wherein the dumbbell further comprises a half weight plate, a middle part of the half weight plate is provided with a lifting hook, and multiple flanges are set up in an outer circumferential ring array of the turnplate; under a set rotation position of the turnplate, the flange is located directly below the lifting hook.

6. The dumbbell of claim 1, wherein a locking plate is placed on an outer circumference of the turnplate, a ring gear is arranged on the outer circumference of the turnplate, and a stop gear is set up on an inner circumference of the locking plate which is provided with a top spring that is used to drive an engagement between the stop gear and the ring gear.

7. The dumbbell of claim 6, wherein a base is used to place the dumbbell, and the base is provided with a top block to press against the locking plate in a vertical direction.

8. The dumbbell of claim 1, wherein the dumbbell further comprises a locking piece, the weight plate having a disc-shaped structure with a set thickness, a middle part of the weight plate is provided with a hole available for a retractable rod, a notch for an insertion of the locking piece is set up on an outer circumference of the weight plate, and the locking piece is connected to two weight plates.

9. The dumbbell of claim 8, wherein a top and bottom of the weight plate are provided with notches, an inner wall of the notch has a slot available for the locking piece, a pin passes through the slot, an outer circumference of the locking piece has a semicircle matched with an outer circumference of the pin, the locking piece is provided with card slots and cardboards, and the card slots and card boards are respectively connected to adjacent cardboards and card slots of the card slots and card boards.

10. The dumbbell of claim 1, wherein the weight adjustment mechanism is composed of an end plate and a housing; the end plate is fixedly connected to the housing, a chamber is formed inside to accommodate the turnplate, an outer end of the end plate is connected to the weight plate, the toothed disc is fixedly connected at an inner end of the end plate, and the rotary drum passes through the housing and the end plate; a spherical gear is set up on an outer circumference of the driving wheel, a rotation direction plane of the driving wheel is coincident with an axis of the rotary drum, and an outer wall of the rotary drum is provided with a slot available for the driving wheel; the dumbbell further comprising a counting module, the counting module is composed of a counting ring, a planetary gearset, an annular gear, and a counting gear, the counting gear is coaxially arranged on the turnplate, the counting ring is coaxially placed on an outer circumference of the turnplate, the planetary gearset is set up along a circumferential direction of the counting ring, the annular gear is placed on an inner circumference of the housing, inner and outer sides of the planetary gearset respectively engage with the counting gear and the annular gear, a weight mark is set up on an outer circumference of the counting ring, and the outer wall of the housing is provided with a window used to observe the outer circumference of the counting ring; the dumbbell further comprising a half weight plate, the half weight plate is located below the housing, a middle part of the half weight plate is provided with a lifting hook, and a bottom of the housing has an opening for the lifting hook to pass upwards; a locking plate is included, and is placed on the outer circumference of the turnplate, with a top spring, and both ends of the top spring are respectively connected to the locking plate and the end plate.

* * * * *